US008003568B2

(12) United States Patent
Matsunaga et al.

(10) Patent No.: US 8,003,568 B2
(45) Date of Patent: Aug. 23, 2011

(54) THERMOSENSITIVE RECORDING MATERIAL

(75) Inventors: Yoshiaki Matsunaga, Numazu (JP); Shinji Takano, Numazu (JP); Takeshi Kajikawa, Shizuoka (JP); Toshiaki Ikeda, Shizuoka (JP); Masafumi Kumoda, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 987 days.

(21) Appl. No.: 11/900,806

(22) Filed: Sep. 12, 2007

(65) Prior Publication Data

US 2008/0280757 A1 Nov. 13, 2008

(30) Foreign Application Priority Data

Sep. 15, 2006 (JP) ..... 2006-251292

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | | |
|---|---|---|---|---|
| 5,457,080 | A | 10/1995 | Takano et al. | |
| 5,919,729 | A | 7/1999 | Mori et al. | |
| 5,972,836 | A | 10/1999 | Morita et al. | |
| 6,017,848 | A | 1/2000 | Mando et al. | |
| 6,593,272 | B2 | 7/2003 | Kakuda et al. | |
| 6,660,688 | B2 | 12/2003 | Yamada et al. | |
| 6,696,150 | B2 | 2/2004 | Ikeda et al. | |
| 6,821,556 | B2 * | 11/2004 | Ishida et al. | 427/152 |
| 6,828,017 | B2 | 12/2004 | Kugo et al. | |
| 6,846,619 | B2 | 1/2005 | Kaneko et al. | |
| 6,972,272 | B2 * | 12/2005 | Iwasaki et al. | 503/216 |
| 7,021,214 | B2 | 4/2006 | Kugo et al. | |
| 7,056,552 | B2 | 6/2006 | Kugo et al. | |
| 7,078,365 | B2 | 7/2006 | Kajikawa et al. | |
| 7,635,661 | B2 * | 12/2009 | Iida et al. | 503/207 |
| 2002/0155950 | A1 | 10/2002 | Iwasaki et al. | |
| 2002/0187897 | A1 | 12/2002 | Ishida et al. | |
| 2003/0087759 | A1 | 5/2003 | Iwasaki et al. | |
| 2006/0063013 | A1 | 3/2006 | Ikeda et al. | |
| 2006/0205593 | A1 | 9/2006 | Kadota et al. | |
| 2007/0184978 | A1 | 8/2007 | Takano et al. | |
| 2007/0225164 | A1 | 9/2007 | Kajikawa et al. | |
| 2007/0270309 | A1 | 11/2007 | Iida et al. | |
| 2008/0103041 | A1 | 5/2008 | Iida et al. | |

FOREIGN PATENT DOCUMENTS

| | | | |
|---|---|---|---|
| EP | 0899126 | A1 | 3/1999 |
| EP | 1211094 | A2 | 6/2002 |
| EP | 1702762 | A1 | 9/2006 |
| EP | 1810835 | A1 | 7/2007 |
| EP | 1816003 | A1 | 8/2007 |
| JP | 8-151412 | | 6/1996 |
| JP | 10-87936 | | 4/1998 |
| JP | 11-314457 | | 11/1999 |
| JP | 2002-127601 | | 5/2002 |
| JP | 2002-283717 | | 10/2002 |
| JP | 2006-62189 | | 3/2006 |
| WO | WO2006/049175 | A1 | 5/2006 |
| WO | WO2006/070594 | A1 | 7/2006 |

OTHER PUBLICATIONS

U.S. Appl. No. 11/654,063, filed Jan. 16, 2007.
European search report in connection with corresponding European patent application No. EP 07 11 6495, Jan. 2008.

* cited by examiner

*Primary Examiner* — Bruce H Hess
(74) *Attorney, Agent, or Firm* — Cooper & Dunham LLP

(57) ABSTRACT

Provided is a thermosensitive recording material that comprises a support, a thermosensitive coloring layer on the support, and a protective layer on the thermosensitive coloring layer, wherein the thermosensitive coloring layer comprises a leuco dye and a color developer, and the protective layer comprises a diacetone-modified polyvinyl alcohol resin and a (meth)acrylic resin.

7 Claims, No Drawings

THERMOSENSITIVE RECORDING MATERIAL

BACKGROUND

1. Technical Field

This disclosure relates to thermosensitive recording materials that are favorably utilized in various fields such as of computer outputs, calculator printers, medical meter recorders, low-speed or high-speed facsimiles, ticket vendors and handy terminals.

2. Description of the Related Art

A number of proposals have been made heretofore for thermosensitive recording materials that have a thermosensitive coloring layer containing at least a leuco dye and a color developer on a support and make use of a coloring reaction between the leuco dye and the color developer. The thermosensitive recording materials have such benefits as (i) complicated procedures like development and fixing are unnecessary, and recording can be carried out by use of relatively simple devices in a short period, (ii) noise is low, and (iii) cost is inexpensive, therefore, have been widely used for copies of books or literatures, and for recording materials of computers, facsimiles, ticket vendors, label printers, recorders, handy terminals, or the like.

The thermosensitive recording materials have been desired for quick color development into high concentration as well as high toughness of colored images and background. In recent years, the thermosensitive recording materials have been frequently used for labels etc. that are importantly required for the reliability of recorded images, in particular, those having high storage stability for plasticizers and fats-oils are demanded that are included into organic polymer materials of packages.

Thermosensitive recording materials have hence been proposed that are provided with a protective layer on the thermosensitive coloring layer. The binder resins in the protective layer are exemplified by polyvinyl alcohol, modified polyvinyl alcohol, or combinations thereof and water-proof agents. For example, a combination of a diacetone-modified polyvinyl alcohol and a hydrazine compound is proposed (see Japanese Patent Application Laid-Open (JP-A) No. 08-151412). However, when the proposed material is employed in the protective layer, there arises such a problem that the coating liquid for the protective layer increases its viscosity with time since a water-proof reaction is promoted under the coated condition.

A thermosensitive recording material is also proposed in which a diacetone-modified polyvinyl alcohol is employed as a binder resin of the protective layer and a hydrazine compound is included into the thermosensitive coloring layer (see JP-A No. 11-314457). However, this proposal suffers from insufficient water resistance of the protective layer, viscosity rise of the coating liquid for thermosensitive coloring layer, and/or coloring inhibition at the thermosensitive coloring layer due to the hydrazine compound.

A thermosensitive recording material is also proposed in which a polyvinyl alcohol copolymer containing diacetone acrylamide as its monomer, a water-soluble hydrazine compound, and a water-soluble amine are used (see JP-A No. 10-87936). However, when the proposed material is employed in the protective layer, there arise such problems as the background develops a color due to an adverse effect of the water-soluble amine on the thermosensitive coloring layer, pH control is difficult, and viscosity rise of the liquid may be promoted depending on the amount of the water-soluble amine.

In order to improve these problems, JP-A No. 2002-283717 discloses a thermosensitive recording material in which a polyvinyl alcohol having a reactive carbonyl group, a hydrazide compound, and a basic filler are combined. This proposal may improve the problem of viscosity rise.

However, the thermosensitive recording material, which employs the polyvinyl alcohol having a reactive carbonyl group and the hydrazide compound as described in JP-A No. 2002-283717, suffers from such a problem that images printed with aqueous flexographic ink are easily removed away by an external force upon contacting the images with water for a long period; and this problem is currently demanded to be solved.

BRIEF SUMMARY

In an aspect of this disclosure, there is provided a highly-sensitive thermosensitive recording material that imparts excellent water resistance, superior transportability under high temperature and high humidity conditions, and appropriate sticking property under low temperature and low humidity conditions to images of aqueous flexographic ink printed on its surface.

It was determined through substantial investigation, as discussed herein, that the images of aqueous flexographic ink printed on the surface of thermosensitive recording material can be effectively prevented from their removal even upon contacting with water and the printed images are improved in terms of their water resistance, provided that the thermosensitive recording material comprises a thermosensitive coloring layer on a support and a protective layer on the thermosensitive coloring layer, and the thermosensitive coloring layer comprises a leuco dye and a color developer, and the protective layer comprises a diacetone-modified polyvinyl alcohol resin and a (meth)acrylic resin.

Various other aspects and features are discussed herein, such as, for example, the following:

<1> A thermosensitive recording material, comprising a support, a thermosensitive coloring layer on the support, and a protective layer on the thermosensitive coloring layer, wherein the thermosensitive coloring layer comprises a leuco dye and a color developer, and the protective layer comprises a diacetone-modified polyvinyl alcohol resin and a (meth)acrylic resin.

<2> The thermosensitive recording material according to <1>, wherein the (meth)acrylic resin is a homopolymer of one of (meth)acrylic acid and (meth)acrylates, or a copolymer of at least one of (meth)acrylic acid and (meth)acrylates as well as a monomer copolymerizable therewith.

<3> The thermosensitive recording material according to <1> or <2>, wherein the (meth)acrylic resin is a styrene-acrylic acid copolymer.

<4> The thermosensitive recording material according to any one of <1> to <3>, wherein the amount of the (meth)acrylic resin in the protective layer is 1 part by mass to 50 parts by mass based on 100 parts by mass of the diacetone-modified polyvinyl alcohol resin.

<5> The thermosensitive recording material according to any one of <1> to <4>, wherein the acid value of the (meth) acrylic resin is no less than 100 mgKOH/g.

<6> The thermosensitive recording material according to any one of <1> to <5>, wherein the protective layer comprises a hydrazide compound, and the hydrazide compound is adipic dihydrazide.

<7> The thermosensitive recording material according to any one of <1> to <6>, wherein the thermosensitive recording material is a thermosensitive recording label that comprises a adhesive layer and a release paper on the surface of the adhesive layer, on the side of the support opposite to the thermosensitive coloring layer.

<8> The thermosensitive recording material according to any one of <1> to <6>, wherein the thermosensitive recording material is a thermosensitive recording label that comprises a thermosensitive adhesive layer that becomes tacky upon heating, on the side of the support opposite to the thermosensitive coloring layer.

The aforementioned thermosensitive recording material comprises a support, a thermosensitive coloring layer on the support, and a protective layer on the thermosensitive coloring layer, wherein the thermosensitive coloring layer comprises a leuco dye and a color developer, and the protective layer comprises a diacetone-modified polyvinyl alcohol resin and a (meth)acrylic resin. The images, printed by the aqueous flexographic ink on the surface of the aforementioned thermosensitive recording material, may have a higher bonding strength at the boundary between the protective layer and the aqueous flexographic ink since a bond generates between the carboxyl group of the acrylic resin in the protective layer and the bonder resin in the aqueous flexographic ink. As a result, the images printed by the aqueous flexographic ink may exhibit excellent water resistance, superior transportability under high temperature and high humidity conditions, and appropriate sticking property under low temperature and low humidity conditions.

The flexographic ink is typically classified into alcohol type and aqueous type depending on the solvent therein. The flexographic ink of alcohol type is typically produced using alcohol solvents of one having a lower-boiling point such as ethanol and one having a higher-boiling point such as glycol. On the other hand, the aqueous type flexographic ink contains water and optional very small amount of alcohol, and contains substantially no solvents, and thus is appropriate for resource saving and environmental sanitation, and is widely used.

The aforementioned aspects and features enable high sensitive thermosensitive recording materials to be produced whereby images printed on the surface thereof by the aqueous flexographic ink may exhibit excellent water resistance, superior transportability under high temperature and high humidity conditions, and appropriate sticking property under low temperature and low humidity conditions.

DETAILED DESCRIPTION OF THE INVENTION

The inventive thermosensitive recording material comprises a support, a thermosensitive coloring layer on the support, a protective layer on the thermosensitive coloring layer, and optional other layers such as a back layer and an intermediate layer as required.

Protective Layer

The protective layer contains a diacetone-modified polyvinyl alcohol resin, a (meth)acrylic resin, a crosslinking agent, and optional other ingredients.

Diacetone-Modified Polyvinyl Alcohol Resin

The diacetone-modified polyvinyl alcohol resin, which being formed of a polyvinyl alcohol of which the hydroxyl group is modified by diacetone, may be properly synthesized or commercially available.

In cases of synthesis, the diacetone-modified polyvinyl alcohol resin may be prepared through conventional processes, for example, by way of saponifying a copolymer obtained from copolymerizing a vinyl monomer having a diacetone group and a fatty acid vinyl ester.

The vinyl monomer having the diacetone group is exemplified by diacetone acrylamide and diacetone methacrylamide.

The fatty acid vinyl ester is exemplified by vinyl formate, vinyl acetate, and vinyl propionate. Among these, vinyl acetate is preferable in particular.

The diacetone-modified polyvinyl alcohol resin may be one copolymerized with other copolymerizable vinyl monomers. Examples of the copolymerizable vinyl monomers include acrylic acid esters, butadiene, ethylene, propylene, acrylic acid, methacrylic acid, maleic acid, maleic anhydride and itaconic acid.

The amount of the reactive carbonyl group in the diacetone-modified polyvinyl alcohol resin is preferably 0.5 to 20% by mole in the polymer, more preferably 2 to 10% by mole. When the amount is below 0.5% by mole, the water resistance may be practically insufficient, and even when the amount is above 20% by mole, the water resistance may not be enhanced proportionally and the cost tends to be expensive.

The polymerization degree of the diacetone-modified polyvinyl alcohol resin may be properly selected depending on the application; preferably, the polymerization degree is 300 to 3,000, more preferably 500 to 2,000.

(Meth)acrylic Resin

The (meth)acrylic resin may be properly selected from conventional ones, and may be appropriately synthesized or commercially available.

In cases of synthesis, it is preferred that the (meth)acrylic resin is a homopolymer of one of (meth)acrylic acid and (meth)acrylates, or a copolymer of at least one of (meth) acrylic acid and (meth)acrylates as well as a monomer copolymerizable therewith.

The (meth)acrylate may be properly selected depending on the application; for example, the (meth)acrylate is preferably one of monomers or oligomers employed for UV-ray curable resins or electron beam curable resins. Among these, the (meth)acrylate is one having a flexible structure, more preferably an aliphatic compound. In cases of aromatic compounds, the (meth)acrylate preferably has a chain structure. Monofunctional or difunctional monomers are more preferable than polyfunctional polymers of trivalence or more.

Examples of the (meth)acrylate include alkyl(meth)acrylates having an alkyl group, amino(meth)acrylates having an alkyl group, glycol di(meth)acrylate, allyl(meth)acrylate, trimethylolpropane tri(meth)acrylate, glycidyl(meth)acrylate, acrylamide, diacetone acrylamide, (meth)acrylonitrile, benzyl(meth)acrylate, and dimethylaminoethly (meth)acrylate methylchloride salt. These may be used alone or in combination of two or more.

The alkyl(meth)acrylate having an alkyl group may be properly selected depending on the application, its carbon number is preferably 1 to 18, more preferably 3 to 15; specific examples thereof include methyl(meth)acrylate, ethyl(meth) acrylate, n-butyl(meth)acrylate, i-butyl(meth)acrylate, cyclohexyl(meth)acrylate, 2-ethylhexyl(meth)acrylate, lauryl(meth)acrylate, and stearyl(meth)acrylate.

Less carbon number of the alkyl group may lead to insufficient flexibility of the (meth)acrylic resin, and larger carbon number thereof may also lead to insufficient flexibility due to regular arrangement of methylene side chains.

The amino(meth)acrylate having an alkyl group may be properly selected depending on the application, the carbon number is preferably 1 to 5; examples thereof include dimethylaminoethyl(meth)acrylate and diethylaminoethyl(meth) acrylate.

The glycol di(meth)acrylate may be properly selected depending on the application; examples thereof include ethyleneglycol di(meth)acrylate and butyleneglycol di(meth) acrylate.

Examples of the copolymerizable monomer include vinylarenes such as styrene, α-methylstyrene, monochlorostyrene and dichlorostyrene; vinylcyans such as acrylonitrile and methacrylonitrile; halogenated vinyls such as vinyl chloride, vinyl bromide and chloroprene; vinyl acetate; alkenes such as ethylene, propylene, butylene, butadiene and isobutylene; halogenated alkenes; and polyfunctional monomers such as allylmethacrylate, diallylphthalate, triallylcyanurate, monoethyleneglycol dimethacrylate, tetraethyleneglycol dimethacrylate, divinylbenzene, and glycidyl methacrylate.

These (meth)acrylic resins may be used alone or in combination of two or more. Among these, preferable are acrylic resins having a copolymer component of methylacrylate, butylacrylate or 2-etylhexylacrylate, or having a copolymer component thereof as well as a copolymer component of methacrylates, styrene, acrylonitrile, or vinyl acetate; in particular, styrene-acrylic acid copolymers are preferable in view of binding ability with resins in aqueous flexographic ink.

The acrylic resins of water-soluble type and emulsion type may equivalently provide printed images with water resistance; preferably, water-soluble type is employed since emulsion type may provide contradictory effects to decrease barrier property such as plasticizer resistance and oil resistance.

The amount of the (meth)acrylic resin in the protective layer is preferably 1 to 50 parts by mass based on 100 parts by mass of the diacetone-modified polyvinyl alcohol resin, more preferably 5 to 30 parts by mass. When the amount is less than 1 part by mass, the effect on water resistance may be insignificant for the images printed by aqueous flexographic ink, and when the amount is more than 50 parts by mass, the sticking property may be poor under low temperature and low humidity conditions.

The acid value of the (meth)acrylic resin is preferably no less than 100 mgKOH/g, more preferably 150 to 250 mgKOH/g. When the acid value is less than 100 mgKOH/g, the effect on water resistance may be insufficient for the images printed by aqueous flexographic ink. The acid value of the (meth)acrylic resin may be measured in accordance with the procedures defined in JIS K0070, for example.

The mass average molecular mass of the (meth)acrylic resin may be properly selected depending on the application; preferably, the mass average molecular mass is 1,000 to 300,000.

Crosslinking Agent

The crosslinking agent may be properly selected depending on the application; preferably, the crosslinking agent is a hydrazide compound.

The hydrazide compound may be properly selected depending on the application as long as having a hydrazide group; examples thereof include hydrazine, carbohydrazide, oxalic dihydrazide, formic hydrazide, acetic hydrazide, malonic dihydrazide, succinic dihydrazide, adipic dihydrazide, azelaic dihydrazide, sebacic dihydrazide, dodecanedioic acid dihydrazide, maleic dihydrazine, fumaric dihydrazide, itaconic dihydrazide, benzoic hydrazide, glutaric dihydrazide, diglycol acid dihydrazide, tartaric dihydrazide, malic dihydrazide, isophthalic hydrazide, terephthalic dihydrazide 2,7-naphthoic dihydrazide and polyacrylic acid hydrazide. These may be used alone or in combination of two or more. Among these, adipic dihydrazide is particularly preferable from the viewpoint of water resistance and safety.

The amount of the crosslinking agent depends on modification degree, species etc. of the functional group in the crosslinking agent; preferably, the amount of the crosslinking agent is 0.1 to 20 parts by mass based on 100 parts by mass of the diacetone-modified polyvinyl alcohol resin, more preferably 1 to 10 parts by mass.

The inventive crosslinking agent may be combined with conventional crosslinking agents such as glyoxal, melamine, aziridine compounds, polyamide epichlorohydrin resins, ammonium zirconium carbonate and ethylene diamine, within an appropriate range.

The protective layer may contain a filler as required. Examples of the filler include inorganic fine powders such as of aluminum hydroxide, calcium carbonate, silica, zinc oxide, titanium oxide, zinc hydroxide, barium sulfate, clay, talc, surface-treated calcium and surface-treated silica; organic fine powders such as of urea-formalin resins, styrene-methacrylic acid copolymers and polystyrene resins. Among these, aluminum hydroxide and calcium carbonate are particularly preferable from the view point of excellent wear resistance as regards thermal heads on printing for a long period.

The protective layer may be formed by processes properly selected depending on the purpose; preferably, the protective layer is formed by way of coating a liquid for protective layer on the thermosensitive coloring layer.

The coating process may be properly selected depending on the application; examples of the coating process include spin coating processes, dip coating processes, kneader coating processes, curtain coating processes and blade coating processes. Among these, spin coating processes and dip coating processes are particularly preferable in view of coating efficiency.

The coated layer may be dried after the coating process; the drying temperature may be properly selected depending on the application, preferably, the temperature is 100° C. to 250° C.

The coated amount of the protective layer after drying may be properly selected depending on the application; preferably, the coated amount after drying is 0.5 to 5.0 g/m$^2$, more preferably 1.5 to 3.5 g/m$^2$. When the coated amount after drying is less than 0.5 g/m$^2$, the function as the protective layer may be insufficient such that printed images may be discolored by external action of oils, plasticizers, water, chemicals etc., and even when the amount is more than 5.0 g/m$^2$, the function as the protective layer may not be enhanced proportionally, rather the coloring sensitivity may be deteriorated.

Thermosensitive Coloring Layer

The thermosensitive coloring layer contains at least a leuco dye, a color developer, and a binder resin, and also other ingredients as required.

Leuco Dye

The leuco dye may be properly selected from those conventionally used for thermosensitive recording materials depending on the purpose; preferable examples are leuco compounds such as triphenylmethanes, fluorans, phenothiazines, auramines, spiropyranes and indolinophthalides.

Specific examples of the leuco dye include 2-anilino-3-methyl-6-dibutylaminofluoran, 3,3-bis(p-dimethylaminophenyl)phthalide, 3,3-bis(p-dimethylaminophenyl)-6-dimethylaminophthalide (referred to also as Crystal Violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzofluoran, 3-diethylamino-6-methyl-7-chlorofluoran, 3-(N-p-tolyl-N-ethylamino)-6-methyl-7-anilinofluoran, 2-[N-(3'-trifluoromethylphenyl)amino]-6-diethylaminofluoran, 2-[3,6-bis(diethylamino)-9-(o-chloroanilino)xanthylbenzoic acid lactam], 3-diethylamino-6-methyl-7-(m-trichloromethylanilino) fluoran, 3-diethylamino-7-(o-chloroanilino)fluoran, 3-pyrrolidino-6-methyl-7-anilinofluoran, 3-di-n-butylamino-7-o-chloroanilinofluoran, 3-N-methyl-N,n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chloro-5'-methylphenyl)phthalide, 3-(N-ethyl-N-tetrahydrofurfuryl)amino-6-methyl-7-anilinofluoran, 3-N-ethyl-N-(2-ethoxypropyl)amino-6-methyl-7-anilinofluoran, 3-N-methyl-N-isobutyl-6-methyl-7-anilinofluoran, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino) fluoran, 3-(N-ethyl-p-toluidino)-7-(α-phenylethylamino) fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-di-n-butylamino-6-methyl-7-anilinofluoran, 3,6-bis(dimethylamino)fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-diethylamino-6-methyl-7-mesitidino-4',5'-benzofluoran, 3-N-methyl-N-isopropyl-6-methyl-7-anilinofluoran, 3-N-ethyl-N-isoamyl-6-methyl-7-anilinofluoran, 3-diethylamino-6-methyl-7-(2',4'-dimethylanilino)fluoran, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-pyperidinofluoran, 2-chloro-3-(N-methyltoluidino)-7-(p-N-butylanilino)fluoran, 3,6-bis (dimethylamino)fluorenspiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesitidino-4',5'-benzofluoran, 3-(p-dimethylaminophenyl)-3-[1,1-bis(p-dimethylaminophenyl)-ethylene-2-yl]phthalide, 3-(p-dimethylaminophenyl)-3-[1,1-bis(p-dimethylaminophenyl)-ethylene-2-yl]-6-dimethylaminophthalide, 3-(p-dimethylaminophenyl)-3-(1-p-dimethylaminophenyl-1-phenylethylene-2-yl)phthalide, 3-(p-dimethylaminophenyl)-3-(1-p-dimethylaminophenyl-1-p-chlorophenylethylene-2-yl)-6-dimethylaminophthalide, 3-(4'-dimethylamino-2'-methoxy)-3-(1"-p-dimethylaminophenyl-1"-p-chlorophenyl-1", 3"-butadiene-4"-yl)benzophthalide, 3-(4'-dimethylamino-2'-benzyloxy)-3-(1"-p-dimethylaminophenyl-1"-phenyl-1",3"-butadiene-4"-yl) benzophthalide, 3-dimethylamino-6-dimethylamino-fluorene-9-spiro-3'-(6'-dimethylamino)phthalide, 3,3-bis[2-(p-dimethylaminophenyl)-2-(p-methoxyphenyl)ethenyl]-4,5,6,7-tetrachlorophthalide, 3-bis[1,1-bis(4-pyrrolidinophenyl) ethylene-2-yl]-5,6-dichloro-4,7-dibromophthalide, bis(p-dimethylaminostyryl)-1-naphthalenesulfonylmethane, bis (p-dimethylaminostyryl)-1-p-tolylsulfonylmethane. These may be used alone or in combination of two or more.

Color Developer

The color developer may be various electron-accepting compounds or oxidants that colors the leuco dyes upon contacting therewith.

The color developer may be properly selected from conventional ones; specific examples thereof include 4,4'-isopropylidene bisphenol, 4,4'-isopropylidene bis(o-methylphenol), 4,4'-sec-butylidene bisphenol, 4,4'-isopropylidenebis (2-ter-butylphenol), p-nitrobenzoic acid zinc, 1,3,5-tris(4-ter-butyl-3-hydroxy-2,6-dimethylbenzyl)isocyanuric acid, 2,2-(3,4'-dihydroxydiphenyl)propane, bis(4-hydroxy-3-methylphenyl)sulfide, 4-[β-(p-methoxyphenoxy)ethoxy]salicylic acid, 1,7-bis(4-hydroxyphenylthio)-3,5-dioxaheptane, 1,5-bis(4-hydroxyphenylthio)-5-oxapentane, monobenzylphthalate mono calcium salt, 4,4'-cyclohexylidenediphenol, 4,4'-isopropylidene bis(2-chlorophenol), 2,2'-methylenebis(4-methyl-6-ter-butylphenol), 4,4'-butylidenebis(6-ter-butyl-2-methyl)phenol, 1,1,3-tris(2-methyl-4-hydroxy-5-ter-butylphenyl)butane, 1,1,3-tris(2-methyl-4-hydroxy-5-cyclohexylphenyl)butane, 4,4'-thiobis(6-ter-butyl-2-methyl) phenol, 4,4'-diphenolsulfone, 4-isopropoxy-4'-hydroxydiphenylsulfone-(4-hydroxy-4'-isopropoxydiphenylsulfone), 4-benzyloxy-4'-hydroxydiphenylsulfone, 4,4'-diphenolsulfoxide, p-hydroxyisopropylbenzoate, p-hydroxybenzylbenzoate, benzyl protocatechuate, stearyl gallicate, lauryl gallicate, octyl gallicate, 1,3-bis(4-hydroxyphenylthio)propane, N,N'-diphenylthiourea, N,N'-di(m-chlorophenyl)thiourea, salicylanilide, bis(4-hydroxyphenyl)methylacetate, bis(4-hydroxyphenyl)benzylacetate, 1,3-bis(4-hydroxycumyl)benzene, 1,4-bis(4-hydroxycumyl)benzene, 2,4'-duphenolsulfone, 2,2'-diallyl-4,4'-diphenolsulfone, 3,4-dihydroxyphenyl-4'-methyldiphenylsulfone, 1-acetyloxy-2-zinc naphthoate, 2-acetyloxy-1-zinc naphthoate, 2-acetyloxy-3-zinc naphthoate, α,α-bis(4-hydroxyphenyl)-α-methyltoluene, antipyrine complex of zinc thiocyanate, tetrabromobisphenol A, tetrabromobisphenol S, 4,4'-thiobis(2-methylphenol) and 4,4'-thiobis(2-chlorophenol). These may be used alone or in combination of two or more.

The amount of the color developer is preferably 1 to 20 parts by mass based on 1 part of the leuco dye, more preferably 2 to 10 parts by mass.

Binder Resin

The binder resin may be properly selected from conventional ones depending on the application; examples thereof include polyvinyl alcohol; starch and its derivatives; cellulose derivatives such as methoxy cellulose, hydroxyethyl cellulose, carboxymethyl cellulose, methyl cellulose and ethyl cellulose; water-soluble polymers such as sodium polyacrylate, polyvinyl pyrrolidone, acrylamide-acrylate copolymers, acrylamide-acrylate-methacrylic acid terpolymers, alkali salts of styrene-maleic anhydride copolymers, alkali salts of isobutylene-maleic anhydride copolymers, polyacrylamide, sodium alginate, gelatin and casein; emulsions such as of polyvinyl acetate, polyurethane, polyacrylic acid, polyacrylate, polymethacrylate, polybutylmethacrylate, vinyl chloride-vinyl acetate copolymers and ethylene-vinyl acetate copolymers; and latexes such as styrene-butadiene copolymers and styrene-butadiene-acrylate terpolymers. These may be used alone or in combination of two or more.

The thermosensitive coloring layer may contain various heat-meltable substances as sensitivity enhancing agents. Examples of the heat-meltable substances include fatty acids such as stearic acid and behenic acid; fatty acid amides such as stearic acid amide and palmitic acid amide; metal salts of fatty acid such as zinc stearate, aluminum stearate, calcium stearate, zinc palmitate and zinc behenate; p-benzylbiphenyl, terphenyl, triphenylmethane, p-benzyloxybenzylbenzoate, β-benzyloxynaphthalene, β-phenylnaphthoate, 1-hydroxy-2-phenylnaphthoate, 1-hydroxy-2-methylnaphthoate, diphenylcarbonate, dibenzyl terephthalate, dimethyl terephthalate, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibenzyl disulfide, 1,1-diphenylethanol, 1,1-diphenylpropanol, p-(benzyloxy)benzylalcohol, 1,3-diphenoxy-2-propanol, N-octadecylcarbamoyl-p-methoxycarbonylbenzene, N-octadecylcarbamoylbenzene, dibenzyl oxalate and 1,5-bis(p-methoxyphenoxy)-3-oxapentane. These may be used alone or in combination of two or more.

The thermosensitive coloring layer may contain optionally various auxiliary additives such as surfactants, lubricants and fillers. Examples of the lubricant include higher fatty acids and metal salts thereof, higher fatty acid amides, higher fatty acid esters, animal waxes, vegetable waxes, mineral waxes and petroleum waxes.

Examples of the filler include inorganic fine powders such as calcium carbonate, silica, zinc oxide, titanium oxide, aluminum hydroxide, zinc hydroxide, barium sulfate, clay, kaolin, talc, surface-treated calcium and surface-treated silica; organic fine powders such as of urea-formalin resins, styrene-methacrylic acid copolymers, polystyrene resins and vinylidene chloride resins.

The thermosensitive coloring layer may be properly formed by conventional processes; for example, the leuco dye and the color developer are separately milled and dispersed, together with a binder and/or other ingredients, into a particle diameter of 0.1 to 3 μm using milling apparatuses such as ball mills, attritors and sand mills, then are mixed together with a filler, a lubricant, etc. as required under a pre-determined formulation, thereby to prepare a coating liquid for a thermosensitive coloring layer, then which is coated on a support to prepare a thermosensitive coloring layer.

The coated amount of the thermosensitive coloring layer after drying depends on the composition and application thereof, and is not limited specifically; preferably, the coated amount is 1 to 20 g/m$^2$, more preferably 3 to 10 g/m$^2$.

Support

The support may be properly selected with respect to the shape, configuration, size, material, etc. depending on the purpose. The shape may be sheet-like, roll-like, plate-like, etc.; the configuration may be mono-layer or laminate layer; the size may be appropriately selected depending on the size of thermosensitive recording materials etc. Examples of the material include plastic film, synthetic paper film, high quality paper, recycled pulp, recycled paper, one-side glazed paper, oil resistant paper, coated paper, art paper, cast-coated paper, light weight coated paper, and resin-laminated paper.

More specifically, the support may be paper, film, synthetic paper, or release coated paper. The paper may be acid paper or acid-free paper. The release coated paper, which being formed of acid-free paper and its support, is preferably of lower calcium content. Such release coated paper of lower calcium content may be produced by way of reducing the content of old paper in the paper making process. In addition, talc or clay is used as the internal additive in combination with a neutral rosin sizing agent when producing acid-free paper of lower calcium content, although calcium carbonate is used as the internal additive and alkylketene dimer or alkenyl succinic acid anhydride is used as a neutral rosin sizing agent in usual processes.

The thickness of the support may be properly selected depending on the application; preferably, the thickness is 30 to 2,000 μm, more preferably 50 to 1,000 μm.

The inventive thermosensitive recording material may be constructed to contain the support, the thermosensitive coloring layer on the support, and the protective layer on the thermosensitive coloring layer; a back layer may be disposed on the side of the support opposite to the thermosensitive coloring layer; and an intermediate layer or a heat-insulating layer may be disposed between the support and the thermosensitive coloring layer, between the thermosensitive coloring layer and the protective layer, and/or the support and the back layer. It is particularly preferable among these that a heat-insulating layer is disposed between the support and the thermosensitive coloring layer. The heat-insulating layer preferably contains hollow resin particles having an empty rate of 80% or more as a filler. These layers may be of mono-layer or multi-layer.

The inventive thermosensitive recording material may exhibit significantly high contact with thermal heads by treating with calenders, thus it is particularly preferable to treat the thermosensitive coloring layer or the protective layer with calenders. That is, highly fine and precise and thermosensitive recording material free from background blushing can be obtained by controlling the surface smoothness of the thermosensitive coloring layer or the protective layer by means of a pressure of calender treatment.

Thermosensitive Recording Label

The thermosensitive recording label in the first embodiment, which being one of inventive thermosensitive recording material, contains a adhesive layer on the side of the support opposite to the thermosensitive coloring layer, a release paper on the surface of the adhesive layer, and optional other components. The back layer described above may be also disposed on the same side.

The material of the adhesive layer may be properly selected depending on the application; examples of the material include urea resins, melamine resins, phenol resins, epoxy resins, vinyl acetate resins, vinyl acetate-acrylate copolymers, ethylene-vinyl acetate copolymers, acrylic resins, polyvinylether resins, vinyl chloride-vinyl acetate copolymers, polystyrene resins, polyester resins, polyurethane resins, polyamide resins, chlorinated polyolefin resins, polyvinyl butyral resins, acrylate copolymers, methacrylate copolymers, natural rubbers, cyanoacrylate resins and silicone resins. These may be used alone or in combination.

The thermosensitive recording label in the second embodiment has a thermosensitive adhesive layer that becomes tacky upon heating and other optional components on the back side of the support opposite to the thermosensitive recording layer. The back layer described above may be also disposed on the same side.

The thermosensitive adhesive layer includes a thermoplastic resin, a heat-meltable substance, and an optional adhesive auxiliary agent.

The thermoplastic resin may afford tackiness and/or adhesive force. The heat-meltable substance, which being solid at room temperature thus far from the plasticity, may represent tackiness through swelling and/or softening a resin upon heating and melting. The adhesive auxiliary agent may enhance tackiness.

Thermosensitive Magnetic Recording Paper

The thermosensitive magnetic recording paper, which being one of thermosensitive recording materials, has a magnetic recording layer and other optional components on the back side of the support opposite to the thermosensitive recording layer. The back layer described above may be also disposed on the same side.

The magnetic recording layer may be formed on the support through coating by use of iron oxide, barium ferrite or the like as well as vinyl chloride, urethane, nylon resins or the like, alternatively through vapor-deposition or sputtering with no use of resins.

The magnetic recording layer is preferably formed on the side of the support opposite to the thermosensitive coloring layer, alternatively may be disposed between the support and the thermosensitive coloring layer or on a part of the thermosensitive coloring layer.

The shape of the thermosensitive recording material may be properly selected depending on the purpose; preferable shape is label-like, sheet-like or roll-like.

The process for recording the thermosensitive recording material according to the present invention may be carried out, without limitation, by use of heat pens, thermal heads, laser heating, etc.

The thermosensitive recording materials according to the present invention may be appropriately used in a wide variety of fields such as POS field like perishable foods, lunch boxes and daily dishes; copy fields like books and literatures; communication field like facsimile; ticketing field like ticketing devices, receipts and acknowledgement; air plane field like package tags; and may be favorably used under conditions or sites where water contacts with thermosensitive recording material like within refrigerators, on display racks in supermarkets, or around water systems, since images printed by aqueous flexographic ink on the thermosensitive recording materials are not easily removed away even after contacting with water for a long period.

EXAMPLES

The present invention will be explained with reference to Examples, which are given for no more than illustration of the invention rather than for limiting its intended scope. All percentages and parts are by mass unless indicated otherwise.

Example 1

Preparation of Thermosensitive Recording Material (1) Preparation of Dye Dispersion (A Liquid)

The composition of the ingredients below was milled and dispersed till an average particle diameter of 0.5 μm using a sand mill to prepare A liquid.

| | |
|---|---|
| 2-anilino-3-methyl-6-dibutylaminofluoran | 20 parts |
| 10% aqueous solution of PVA*1) | 20 parts |
| water | 60 parts |

*1)PVA: polyvinyl alcohol (2) Preparation B Liquid

The composition of the ingredients below was milled and dispersed till an average particle diameter of 1.5 μm using a ball mill to prepare B liquid.

| | |
|---|---|
| aluminum hydroxide | 20 parts |
| 4-hydroxy-4'-isopropoxydiphenylsulfone | 20 parts |
| 10% aqueous solution of PVA | 20 parts |
| water | 40 parts |

(3) Preparation C Liquid

The composition of the ingredients below was milled and dispersed till an average particle diameter of 1.5 μm using a ball mill to prepare C liquid.

| | |
|---|---|
| aluminum hydroxide | 100 parts |
| 10% aqueous solution of PVA | 20 parts |
| water | 40 parts |

(4) Preparation of Coating Liquid for Thermosensitive Coloring Layer

The composition of the ingredients below was mixed to prepare a coating liquid for thermosensitive coloring layer.

| | |
|---|---|
| A liquid described above | 20 parts |
| B liquid described above | 60 parts |
| aqueous solution of resin*1) | 30 parts |
| aqueous solution of dioctyl sulfosuccinate*2) | 1 part |

*1)diacetone-modified PVA, solid content: 10%

*2)solid content: 5%

(5) Preparation of Coating Liquid for Protective Layer

The composition of the ingredients below was mixed to prepare a coating liquid for protective layer.

| | |
|---|---|
| C liquid described above | 60 parts |
| aqueous solution of diacetone-modified PVA*1) | 100 parts |
| aqueous solution of acrylic resin*2) | 20 parts |
| aqueous solution of adipic dihydrazide*3) | 10 parts |
| aqueous solution of dioctyl sulfosuccinate*4) | 1 part |

*1)solid content: 10%

*2)acid value: 600 mgKOH/g, sodium polyacrylate, Jurymer AC103, solid content: 10%, by Nihon Junyaku Co.

*3)solid content: 10%

*4)solid content: 5%

(6) Preparation of Thermosensitive Recording Material

The coating liquid for thermosensitive coloring layer was coated on a support of high quality paper with a basic weight of 60 g/m$^2$ in an amount of 0.50 g/m$^2$ as regards the deposited dye thereon and dried to form a thermosensitive coloring layer. The coating liquid for protective layer was then coated on the thermosensitive coloring layer in an amount of 3.0 g/m$^2$ as regards the dried mass thereon to form a protective layer, followed by treating with a super calender. Consequently, the thermosensitive recording paper as the thermosensitive recording material of Example 1 was prepared.

Example 2

Preparation of Thermosensitive Recording Material

The thermosensitive recording material of Example 2 was prepared in the same manner as Example 1, except that 20 parts of an aqueous solution of styrene-acrylic acid copolymer resin (acid value: 195 mgKOH/g, solid content: 10%, Johncryl 61J, by Johnson Polymer Co.) was used in place of the aqueous solution of acrylic resin for the coating liquid for the protective layer of Example 1.

Example 3

Preparation of Thermosensitive Recording Material

The thermosensitive recording material of Example 3 was prepared in the same manner as Example 1, except that 2 parts of an aqueous solution of styrene-acrylic acid copolymer resin (acid value: 195 mgKOH/g, solid content: 10%, Johncryl 61J, by Johnson Polymer Co.) was added in place of the aqueous solution of acrylic resin for the coating liquid for the protective layer of Example 1.

Example 4

Preparation of Thermosensitive Recording Material

The thermosensitive recording material of Example 4 was prepared in the same manner as Example 1, except that 0.5 parts of an aqueous solution of styrene-acrylic acid copolymer resin (acid value: 195 mgKOH/g, solid content: 10%, Johncryl 61J, by Johnson Polymer Co.) was used in place of the aqueous solution of acrylic resin for the coating liquid for the protective layer of Example 1.

Example 5

Preparation of Thermosensitive Recording Material

The thermosensitive recording material of Example 5 was prepared in the same manner as Example 1, except that 45 parts of an aqueous solution of styrene-acrylic acid copolymer resin (acid value: 195 mgKOH/g, solid content: 10%, Johncryl 61J, by Johnson Polymer Co.) was used in place of the aqueous solution of acrylic resin for the coating liquid for the protective layer of Example 1.

Example 6

Preparation of Thermosensitive Recording Material

The thermosensitive recording material of Example 6 was prepared in the same manner as Example 1, except that 55 parts of an aqueous solution of styrene-acrylic acid copolymer resin (acid value: 195 mgKOH/g, solid content: 10%, Johncryl 61J, by Johnson Polymer Co.) was used in place of the aqueous solution of acrylic resin for the coating liquid for the protective layer of Example 1.

Example 7

Preparation of Thermosensitive Recording Material

The thermosensitive recording material of Example 7 was prepared in the same manner as Example 1, except that 20 parts of an aqueous solution of styrene-acrylic acid copolymer resin (acid value: 100 mgKOH/g, solid content: 10%, Johncryl 450, by Johnson Polymer Co.) was used in place of the aqueous solution of acrylic resin for the coating liquid for the protective layer of Example 1.

Example 8

Preparation of Thermosensitive Recording Material

The thermosensitive recording material of Example 8 was prepared in the same manner as Example 1, except that 20 parts of an aqueous solution of styrene-acrylic acid copolymer resin (acid value: 55 mgKOH/g, solid content: 10%, Johncryl 775, by Johnson Polymer Co.) was used in place of the aqueous solution of acrylic resin for the coating liquid for the protective layer of Example 1.

Comparative Example 1

Preparation of Thermosensitive Recording Material

The thermosensitive recording material of Comparative Example 1 was prepared in the same manner as Example 1, except that the aqueous solution of acrylic resin for the coating liquid for the protective layer of Example 1 was not added.

Comparative Example 2

Preparation of Thermosensitive Recording Material

The thermosensitive recording material of Comparative Example 2 was prepared in the same manner as Example 1, except that an aqueous solution of carboxy-modified polyvinyl alcohol (solid content: 10%) was used in place of the aqueous solution of diacetone-modified polyvinyl alcohol (PVA) in the coating liquid for the protective layer of Example 1, an aqueous solution of polyamide epichlorohydrin resin (solid content: 10%) was used in place of the aqueous solution of adipic dihydrazide, and the aqueous solution of acrylic resin (solid content: 10%) was not added.

Comparative Example 3

Preparation of Thermosensitive Recording Material

The thermosensitive recording material of Comparative Example 3 was prepared in the same manner as Example 1, except that an aqueous solution of carboxy-modified polyvinyl alcohol (solid content: 10%) was used in place of the aqueous solution of diacetone-modified polyvinyl alcohol in the coating liquid for the protective layer of Example 1, and an aqueous solution of polyamide epichlorohydrin resin (solid content: 10%) was used in place of the aqueous solution of adipic dihydrazide.

Comparative Example 4

Preparation of Thermosensitive Recording Material

The thermosensitive recording material of Comparative Example 4 was prepared in the same manner as Example 1, except that an aqueous solution of carboxy-modified polyvinyl alcohol (solid content: 10%) was used in place of the aqueous solution of diacetone-modified polyvinyl alcohol in the coating liquid for the protective layer of Example 1.

The construction or ingredients of each protective layer of Examples 1 to 8 and Comparative Examples 1 to 4 are collectively shown in Table 1.

TABLE 1

| | PVA Resin | Crosslinking Agent | Acrylic Resin | Amount of Acrylic Resin (part by mass) | Acid Value of Acrylic Resin (mgKOH/g) |
|---|---|---|---|---|---|
| Ex. 1 | A-1 | C-1 | B-1 | 20 | 600 |
| Ex. 2 | A-1 | C-1 | B-2 | 20 | 195 |
| Ex. 3 | A-1 | C-1 | B-2 | 2 | 195 |
| Ex. 4 | A-1 | C-1 | B-2 | 0.5 | 195 |

TABLE 1-continued

| | PVA Resin | Crosslinking Agent | Acrylic Resin | Amount of Acrylic Resin (part by mass) | Acid Value of Acrylic Resin (mgKOH/g) |
|---|---|---|---|---|---|
| Ex. 5 | A-1 | C-1 | B-2 | 45 | 195 |
| Ex. 6 | A-1 | C-1 | B-2 | 55 | 195 |
| Ex. 7 | A-1 | C-1 | B-3 | 20 | 100 |
| Ex. 8 | A-1 | C-1 | B-4 | 20 | 55 |
| Com. Ex. 1 | A-1 | C-1 | — | — | — |
| Com. Ex. 2 | A-2 | C-2 | — | — | — |
| Com. Ex. 3 | A-2 | C-2 | B-1 | 20 | 600 |
| Com. Ex. 4 | A-2 | C-1 | B-1 | 20 | 600 |

PVA Resin
A-1: diacetone-modified PVA resin (content of reactive carbonyl group: 4.0% by mole)
A-2: carboxy-modified PVA resin
Acrylic Resin
B-1: sodium polyacrylate, acid value: 600 mgKOH/g, Jurymer AC103, by Nihon Junyaku Co.
B-2: styrene-acryl copolymer, acid value: 195 mgKOH/g, Johncryl 61J, by Johnson Polymer Co.
B-3: styrene-acryl copolymer, acid value: 100 mgKOH/g, Johncryl 450, by Johnson Polymer Co.
B-4: styrene-acryl copolymer, acid value: 55 mgKOH/g, Johncryl 775, by Johnson Polymer Co.
Crosslinking Agent
C-1: adipic dihydrazide
C-2: polyamide epichlorohydrin resin The thermosensitive recording materials of Examples 1 to 8 and Comparative Examples 1 to 4 were evaluated for their properties as follows. The results are shown in Table 2.

Evaluation of Water Resistance of Aqueous Flexographic Print

Each of the thermosensitive recording materials was printed with an aqueous flexographic ink (diluted into 25% by mass, MTQ 30302-404, by AKZO Nobel Co.) using a wire bar of wire diameter 0.1 mm to form an image, then which was allowed to stand at 22° C. and 65% RH for 1 hour to dry the image. Then a droplet of water was dropped on the printed image, and the image was rubbed one time intensely by a finger after 5 minutes. Water resistance was evaluated on the basis of the removal level of the printed image in accordance with the criteria shown below.

Criteria as regards Water Resistance of Aqueous Flexographic Printing

A: no removal in printed image
B: 1% to less than 25% of removal in printed image
C: 25% to less than 50% of removal in printed image
D: 50% or more of removal in printed image Sensitivity Magnification Each of the calendered thermosensitive recording materials was printed at a pulse width of 0.0 to 0.7 msec per 1 msec, using a thermosensitive printing test apparatus (by Panasonic Electronic Devices Co.) having a thin-film head, under a condition of head power of 0.45 W/dot•line, recording period of 20 msec/L, and scanning density of 8×385 dots/mm, then the print density was measured using Macbeth densitometer RD914 and the pulse width corresponding to density 1.0 was calculated.

The sensitivity magnification was calculated, on the basis of Comparative Example 1, from the equation of (pulse width in Comparative Example 1)/(pulse width of measured sample). The larger is this value, the more proper is the sensitivity of heat response.

Evaluation of Transportability under High Temperature and High Humidity Condition Each of the calendered thermosensitive recording materials and a printer (SM-90, by Teraoka Seiko Co.) were allowed to stand for 1 hour under a high temperature and high humidity condition of 40° C. and 90% RH thereby to control their humidity, followed by printing and evaluating the transportability based on the printed length. The print length is the length of a certain print pattern from the starting point to the ending point of the pattern printed by the printer. When the transportability is excellent, the print pattern is correctly printed, thus the length of the print pattern to be printed and the length of the actually printed pattern are the same. On the contrary, when the transportability is inferior, the length of the actually printed pattern is shorter than the length of the print pattern to be printed since the printed pattern is shortened by reason of inferior transportation due to sticking between thermosensitive recording materials and thermal heads, shortened printing at printing portions, and also meandering of thermosensitive recording materials at transportation. A print pattern having a printing length of 100 mm was used in this test.

Evaluation of Sticking under Low Temperature and Low Humidity Condition

Each of the calendered thermosensitive recording materials and a printer (L'esprit R-12, by Sato Co.) were allowed to stand for one hour under a low temperature and low humidity condition of 5° C. and 30% RH thereby to control their humidity, followed by printing and evaluating the sticking property.

When the sticking property is excellent, the print pattern is printed correctly. On the contrary, when the sticking property is inferior, the print pattern cannot be printed correctly since the pattern is printed in an overlapped condition on the same site of thermosensitive recording materials. The sticking property was evaluated in accordance with the following criteria based on visual inspection for printed images.

Criteria as regards Sticking Property by Visual Inspection

A: no occurrence of sticking
B: some sticking occurs, non-problematic on quality
C: sticking occurs, problematic on quality
D: incomplete transport, sticking occurs
E: completely non-transportable Evaluation of Water Resistance The test pieces printed using a print simulator (by Ohkura Electric Co.) for thermosensitive recording material at energy 1.00 ms were immersed in 100 ml of water at 20° C. for 24 hours, followed by measuring the image density after the immersion using Macbeth densitometer RD-914. The higher is the value of the image density, the more superior is the water resistance.

TABLE 2

| | Water Resistance of AFP | Sensitivity Magnification | Transportability under HTHH | Sticking under LTLH | Water Resistance |
|---|---|---|---|---|---|
| Ex. 1 | B | 0.99 | 100 mm | A | 1.38 |
| Ex. 2 | A | 1.00 | 100 mm | A | 1.40 |
| Ex. 3 | A | 1.01 | 100 mm | A | 1.39 |
| Ex. 4 | B | 0.99 | 100 mm | A | 1.37 |
| Ex. 5 | A | 1.00 | 100 mm | A | 1.38 |

TABLE 2-continued

| | Water Resistance of AFP | Sensitivity Magnification | Transportability under HTHH | Sticking under LTLH | Water Resistance |
|---|---|---|---|---|---|
| Ex. 6 | A | 1.01 | 80 mm | C | 1.39 |
| Ex. 7 | A | 1.01 | 100 mm | A | 1.39 |
| Ex. 8 | B | 1.00 | 100 mm | A | 1.38 |
| Com. Ex. 1 | D | 1.00 | 100 mm | A | 1.38 |
| Com. Ex. 2 | A | 1.00 | 50 mm | E | 1.00 |
| Com. Ex. 3 | A | 1.00 | 50 mm | E | 1.00 |
| Com. Ex. 4 | D | 1.00 | 30 mm | E | 0.50 |

AFP: Aqueous Flexographic Printing
HTHH: High Temperature and High Humidity Condition
LTLH: Low Temperature and Low Humidity Condition The results shown in Table 2 demonstrate that the inventive thermosensitive recording materials of Examples 1 to 8 exhibit superior transportability under the high temperature and high humidity condition, excellent sticking property at low temperature and low humidity condition, and high water resistance of images printed by aqueous flexographic ink, while maintaining the higher sensitivity magnification, compared to the thermosensitive recording materials of Comparative Examples 1 to 4.

On the contrary, Comparative Example 1 exhibits poor water resistance of images printed by aqueous flexographic ink, and the reason is believed that the protective layer contains a diacetone-modified polyvinyl alcohol resin (PVA) but no acrylic resin.

Comparative Examples 2 and 3 exhibit excellent water resistance of images printed by aqueous flexographic ink since the protective layer contains a carboxy-modified PVA, but the sticking property is poor.

Comparative Example 4 is inferior in the transportability, sticking property and water resistance, the reason is believed that the function of the protective layer is insignificant since the carboxy-modified PVA and adipic dihydrazide undergo no crosslinking reaction.

The thermosensitive recording materials according to the present invention are free from removal of images printed by aqueous flexographic ink thereon even after contacting with water for a long period under conditions or sites where water contacts with thermosensitive recording material like within refrigerators, on display racks in supermarkets, or around water systems, therefore, are appropriate for thermosensitive recording papers, thermosensitive recording labels, thermosensitive magnetic recording papers and thermosensitive recording films, and can be widely used for copy of books and literatures; recording materials for computers, facsimiles, ticket vendors, label printers, recorders and handy terminals; display labels for clothes, labels for parts management, and logistics labels.

What is claimed is:

1. A thermosensitive recording material, comprising:

a support, a thermosensitive coloring layer on the support, and a protective layer on the thermosensitive coloring layer, wherein the thermosensitive coloring layer comprises a leuco dye and a color developer, and the protective layer comprises a diacetone-modified polyvinyl alcohol resin and a (meth)acrylic resin, and the amount of the (meth)acrylic resin in the protective layer is 1 part by mass to 50 parts by mass based on 100 parts by mass of the diacetone-modified polyvinyl alcohol resin.

2. The thermosensitive recording material according to claim 1, wherein the (meth)acrylic resin is a homopolymer of one of (meth)acrylic acid and (meth)acrylates, or a copolymer of at least one of (meth)acrylic acid and (meth)acrylates as well as a monomer copolymerizable therewith.

3. The thermosensitive recording material according to claim 1, wherein the (meth)acrylic resin is a styrene-acrylic acid copolymer.

4. The thermosensitive recording material according to claim 1, wherein the acid value of the (meth)acrylic resin is no less than 100 mgKOH/g.

5. The thermosensitive recording material according to claim 1, wherein the protective layer comprises a hydrazide compound, and the hydrazide compound is adipic dihydrazide.

6. The thermosensitive recording material according to claim 1, wherein the thermosensitive recording material is a thermosensitive recording label that comprises a adhesive layer and a release paper on the surface of the adhesive layer, on the side of the support opposite to the thermosensitive coloring layer.

7. The thermosensitive recording material according to claim 1, wherein the thermosensitive recording material is a thermosensitive recording label that comprises a thermosensitive adhesive layer that becomes tacky upon heating, on the side of the support opposite to the thermosensitive coloring layer.

* * * * *